US010646051B1

(12) United States Patent
Koseff

(10) Patent No.: US 10,646,051 B1
(45) Date of Patent: May 12, 2020

(54) ERGONOMIC SITTING DEVICE AND METHOD OF USE

(71) Applicant: Howard David Koseff, Vista, CA (US)

(72) Inventor: Howard David Koseff, Vista, CA (US)

( * ) Notice: Subject to any disclaimer, the term of this patent is extended or adjusted under 35 U.S.C. 154(b) by 0 days.

(21) Appl. No.: 16/785,237

(22) Filed: Feb. 7, 2020

Related U.S. Application Data

(60) Provisional application No. 62/922,911, filed on Sep. 6, 2019.

(51) Int. Cl.
*A47C 1/00* (2006.01)
*A47C 7/62* (2006.01)
*A47C 31/12* (2006.01)
*A47C 7/40* (2006.01)

(52) U.S. Cl.
CPC ..... *A47C 31/126* (2013.01); *A47C 7/40* (2013.01); *A47C 7/62* (2013.01)

(58) Field of Classification Search
CPC ..... A47C 31/126; A47C 7/40; A47C 7/62
USPC ..... 297/464, 487, 488
See application file for complete search history.

(56) References Cited

U.S. PATENT DOCUMENTS 2,136,852 A * 11/1938 Knauth ..... A61G 15/02 297/488 X
3,713,694 A * 1/1973 Miller ..... B60R 21/02 297/486
3,761,126 A * 9/1973 Mulholland ..... A61G 5/00 297/467
3,764,180 A * 10/1973 Mulholland ..... A61G 5/12 297/488 X
3,901,550 A * 8/1975 Hamy ..... B60R 21/02 297/488 X
4,906,047 A * 3/1990 Mikami ..... B60N 2/4221 297/464
5,447,356 A * 9/1995 Snijders ..... A47C 7/405 297/487 X
7,914,471 B2 * 3/2011 Chen ..... A61H 23/0263 297/284.9
9,216,676 B1 * 12/2015 Reyes Luna ..... B60N 2/986
9,352,675 B2 * 5/2016 Walker ..... B60N 2/865
9,402,482 B2 * 8/2016 Miller ..... A47C 16/00
2004/0127822 A1 * 7/2004 Eisenberg ..... A45D 44/02 601/49
2008/0261787 A1 * 10/2008 Smith ..... A47C 7/62 482/130
2009/0278391 A1 * 11/2009 Ulrich ..... A47C 7/443 297/283.1
2016/0278527 A1 * 9/2016 Planer ..... A47C 1/00

* cited by examiner

*Primary Examiner* — Rodney B White
(74) *Attorney, Agent, or Firm* — Procopio Cory Hargreaves and Savitch LLP

(57) ABSTRACT

An ergonomic sitting device comprising one or more rear supports; a pair of shoulder assemblies configured to extend forward from the one or more rear supports, over a user's shoulders; one or more biasing mechanisms configured to urge the pair of shoulder assemblies rearward towards a back of at least one of a chair and a seat.

12 Claims, 5 Drawing Sheets

ERGONOMIC SITTING DEVICE AND METHOD OF USE

CROSS-REFERENCE TO RELATED APPLICATION

This application claims the benefit of provisional patent application No. 62/922,911 filed on Sep. 6, 2019, which is incorporated by reference herein.

FIELD OF THE INVENTION

The present subject matter relates to devices and method to improve one's upper back posture when sitting.

SUMMARY OF THE INVENTION

An aspect of the invention involves an ergonomic sitting device comprising one or more rear supports; a pair of shoulder assemblies configured to extend forward from the one or more rear supports, over a user's shoulders; one or more biasing mechanisms configured to urge the pair of shoulder assemblies rearward towards a back of at least one of a chair and a seat.

One or more implementations of the aspect of invention described above includes one or more of the following: the one or more biasing mechanisms further configured to urge the pair of shoulder assemblies downward towards a sitting surface of at least one of a chair and a seat; the ergonomic sitting device is part of at least one of a chair and a seat; the chair and a seat are tiltable between at least an upright position and a tilted forward position; the ergonomic sitting device is mountable to at least one of a chair and a seat; and/or the shoulder assemblies includes pads configured to contact an upper part of a user's torso.

Another aspect of the invention involves a method of using the ergonomic sitting device of the aspect of the invention described above comprising receiving an upper part of a user's torso below/beneath the pair of shoulder assemblies; and urging the upper part of the user's torso rearward towards the back of at least one of the chair and the seat with the pair of shoulder assemblies.

One or more implementations of the aspect of invention described above includes one or more of the following urging the upper part of the user's torso downward towards the sitting surface of at least one of the chair and the seat with the pair of shoulder assemblies; the ergonomic sitting device is part of at least one of a chair and a seat; the ergonomic sitting device is mountable to at least one of a chair and a seat; and/or the shoulder assemblies includes pads configured to contact an upper part of a user's torso.

DETAILED DESCRIPTION OF EMBODIMENTS OF INVENTION

Figure 1:
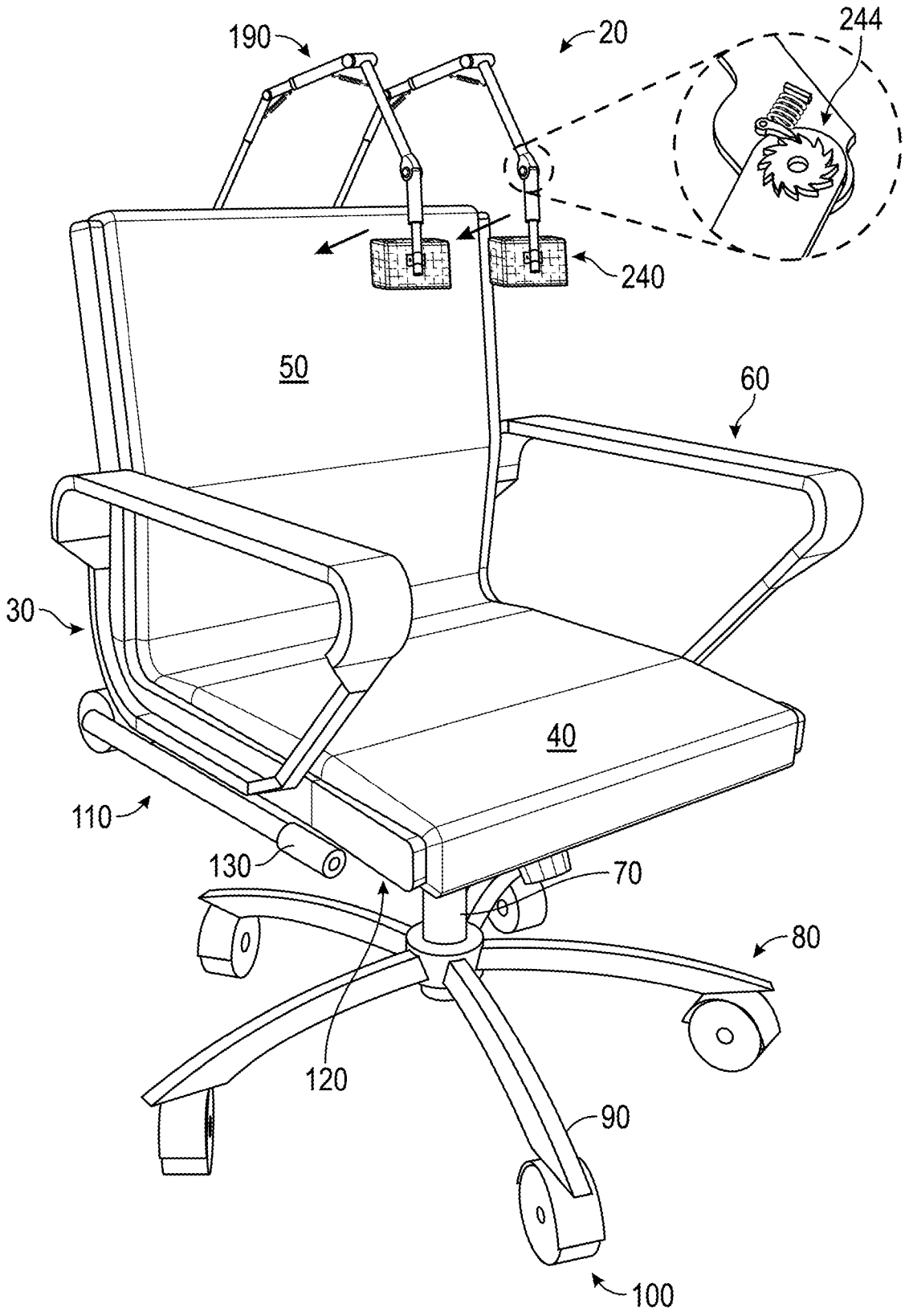
FIG. 1 is a perspective view of an embodiment of an ergonomic sitting device.
Figure 2:
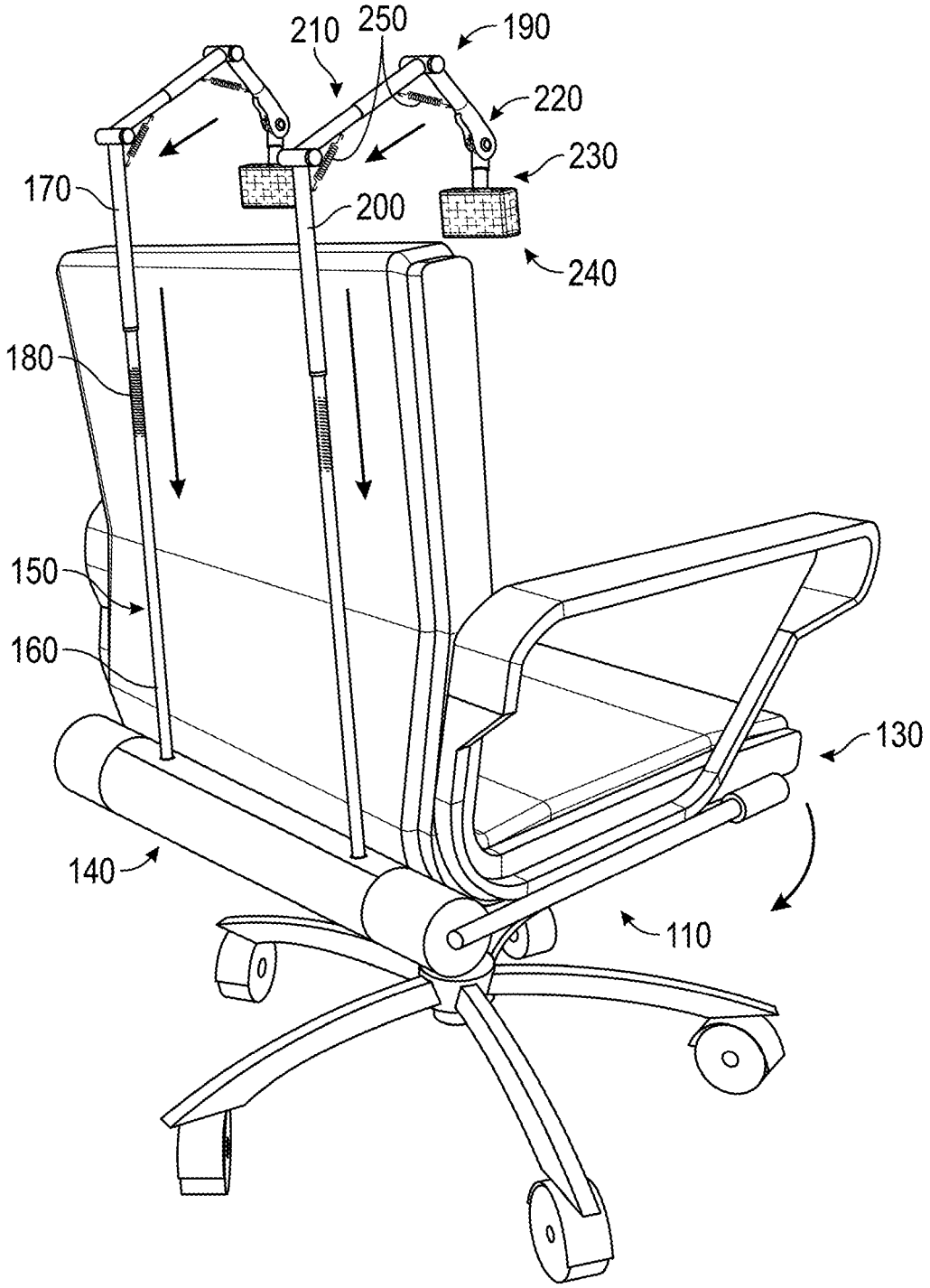
FIG. 2 is a rear perspective view of the ergonomic sitting device of FIG. 1.

With reference to FIGS. 1 to 5, an embodiment of an ergonomic sitting device 20 will be described. The ergonomic sitting device includes a chair 30 having a seat 40, a back 50, arm rests 60 coupled to the seat 40 and the back 50, a vertical support 70 coupled to a bottom of the seat 40, and a base 80 including a plurality of base arms 90 supported by casters/wheels 100. An elongated handle arm 110 extending alongside a side 120 of the seat 40. The handle arm 110 includes a grip 130 at one end and is operably coupled to a rear lower support 140. Actuation of the handle arm 110, as shown in FIG. 2, engages and disengages shoulder assemblies 190.

A pair of rear vertical supports 150 extend vertically upward from the rear lower support 140. The rear vertical supports 150 include telescopingly engaged lower vertical members 160 and upper vertical members 170. Springs 180 in the rear vertical supports 150 urge the upper vertical members 170 downward, as shown in FIG. 2. Shoulder assemblies 190 extend forwardly from upper ends 200 of the upper vertical members 170. The shoulder assemblies 190 are pivotally coupled to the upper ends 200 of the upper vertical members 170. The shoulder assemblies 190 include upwardly and forwardly angled struts 210, downwardly and forwardly angled struts 220, pad support struts 230, and comfort pads 240. Springs 250 between upwardly and forwardly angled struts 210 and downwardly and forwardly angled struts 220 urge the pads 240 rearward, towards the back 50. A ratchet system 244 enables the shoulder pads 240 to be engaged and released by the user. The shown ratchet system 244 is one example of a manually adjustable pad engagement and disengagement mechanism to move the pads 240 rearwards, towards the back 50, or forwards, away from the back 50, and upwards relative to the user's upper torso/shoulders. Springs 180 in the rear vertical supports 150 urge the shoulder assemblies 190 downward, and hence, urge the pads 240 downward.

Figure 3:
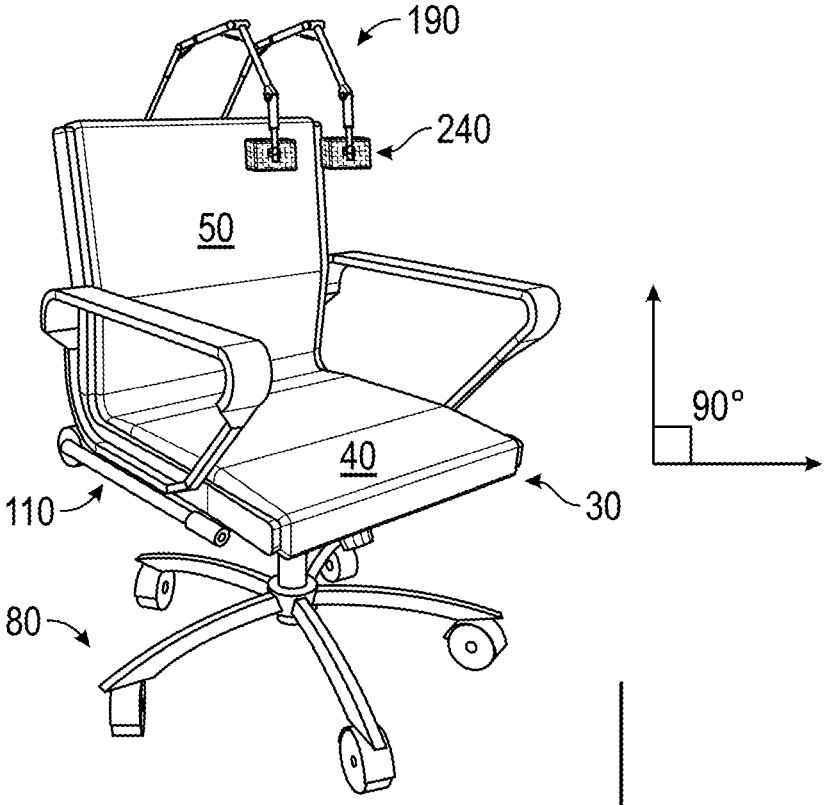
FIG. 3 is a perspective view of the ergonomic sitting device of FIG. 1 and shows the ergonomic sitting device in an upright orientation.
Figure 4:
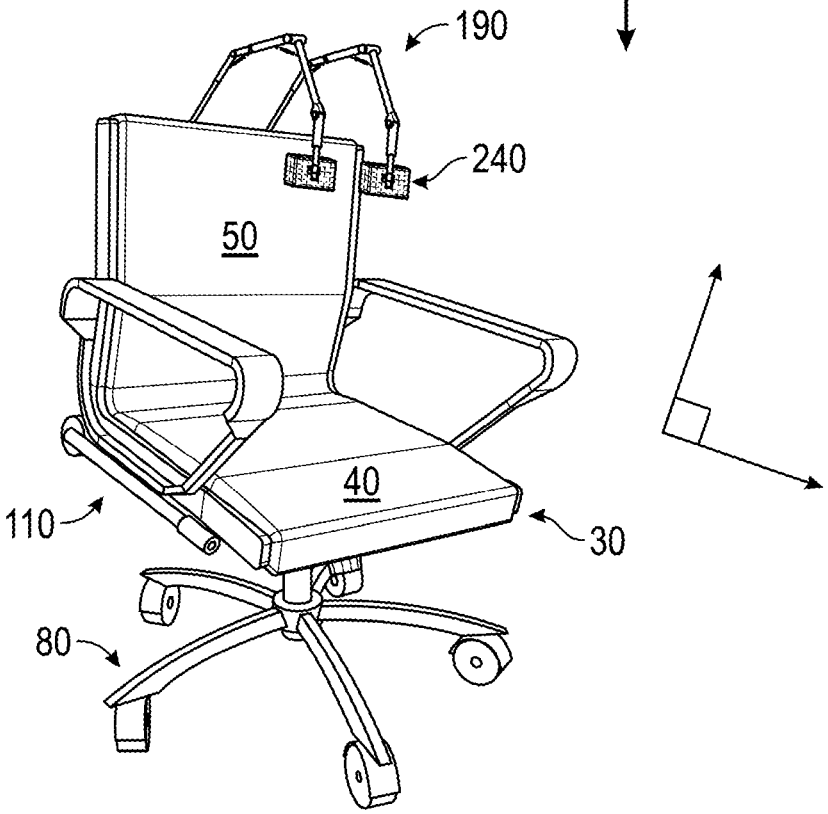
FIG. 4 is a perspective view of the ergonomic sitting device of FIG. 1 and shows the ergonomic sitting device in a forwardly and downwardly angled orientation.
Figure 5:
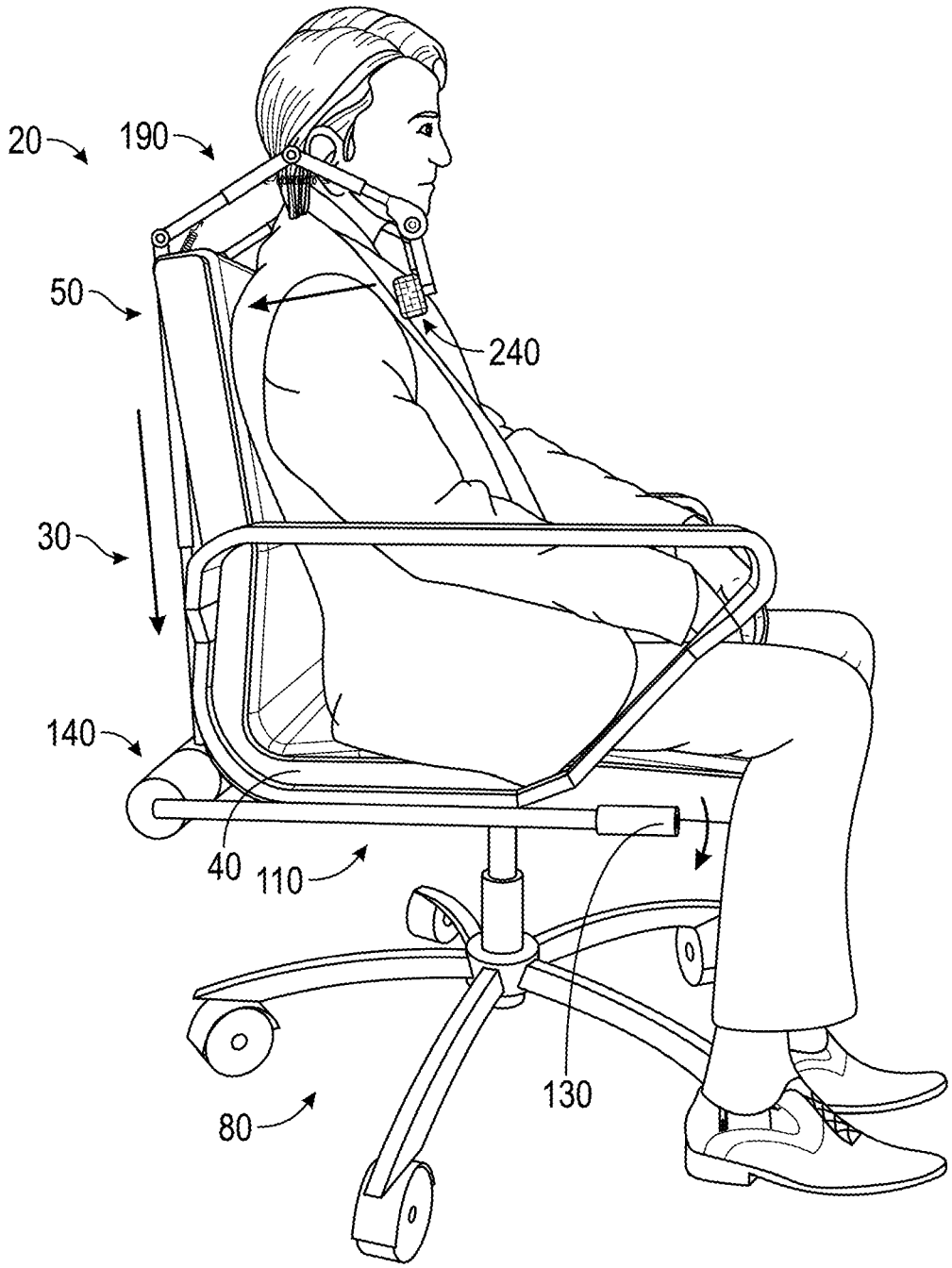
FIG. 5 is a side perspective view of the ergonomic sitting device of FIG. 1 and shows the ergonomic sitting device in conjunction with a user.

In use, the user operates the handle arm 110 to release or engage the pads 240. The center of the user's gravity/weight transfer determines in what position tilt of seat will be. For example, if the center of the user's gravity/weight transfer is back/rearward, the angle of the seat 40 will be in an upright orientation as shown in FIG. 3. If the center of the user's gravity/weight transfer is forward, the angle of the seat 40 will be forwardly and downwardly angled in the orientation shown in FIG. 4.

Releasing the pads 240 with the handle arm 110 allows the user to lift the shoulder assemblies 190 to sit in the chair 30. When the user is sitting in the chair 30, the springs 250 between upwardly and forwardly angled struts 210 and downwardly and forwardly angled struts 220 urge, via the pads 240, the user's shoulders and upper part of the user's torso rearward, towards the back 50 of the chair 30. Springs 180 in the rear vertical supports 150 urge the shoulder assemblies 190 downward, and hence, urge, via the pads 240, the user's shoulders downward. Advantages of pushing shoulders backwards and downwards are that prolonged sitting at a desk results in slouching and forward arching of the upper back and neck as well as the lifting of the shoulders. This causes upper back musculature spasm and tension resulting in upper back discomfort, tenderness and dysfunction. Mechanically pressing the shoulders back and down relaxes the musculature of the upper back and prevents tension, spasm and stress in the upper back, shoulders and neck.

Figure 6:
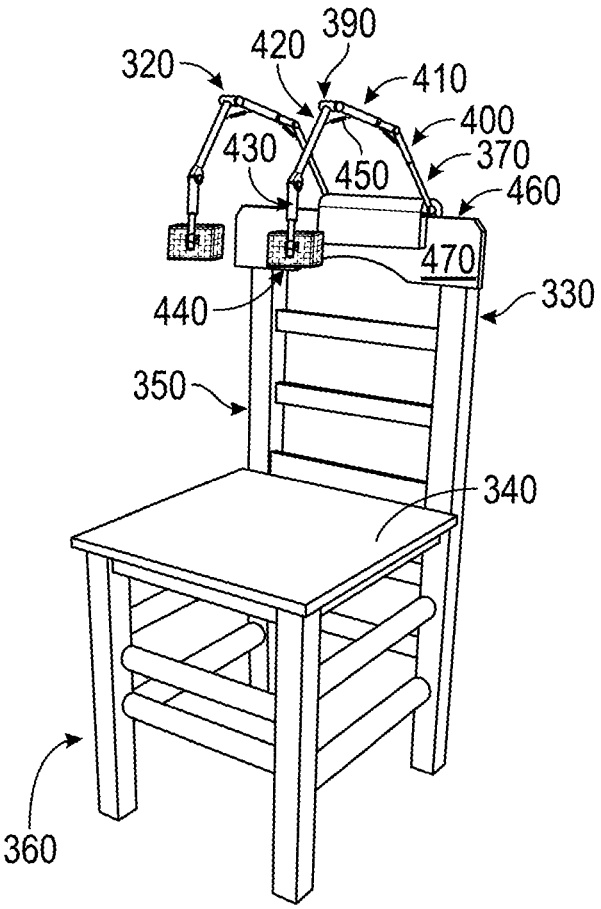
FIG. 6 is a perspective view of another embodiment of an ergonomic sitting device, which is mounted to a chair.
Figure 7:
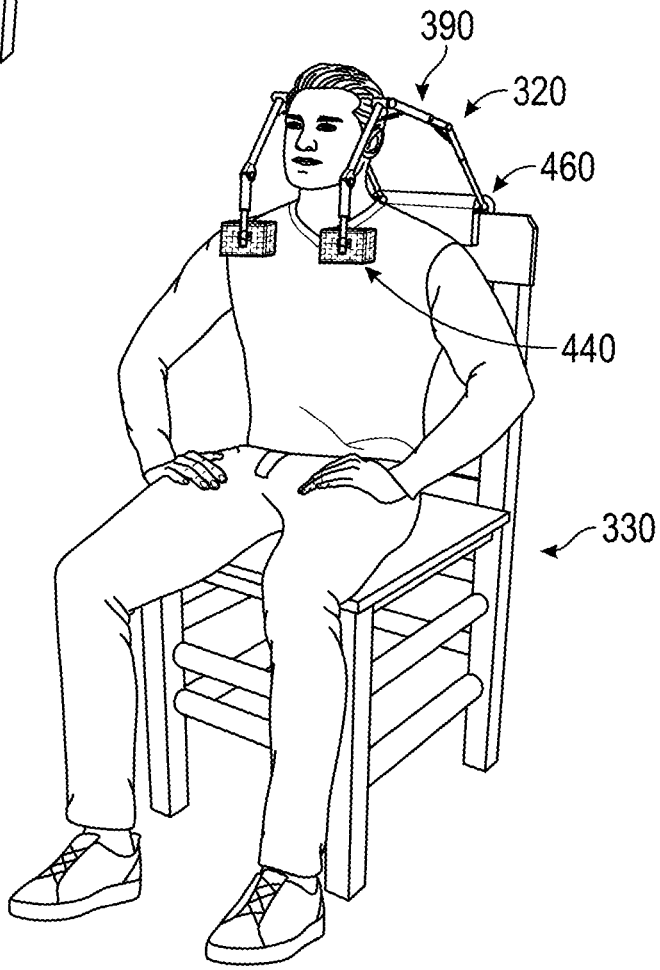
FIG. 7 is a perspective view of the ergonomic sitting device of FIG. 6 and shows the ergonomic sitting device in conjunction with a user sitting in the chair.

FIGS. 6 and 7 illustrate another embodiment of an ergonomic sitting device 320, which is mountable to a chair 330 having a seat 340, a back 350, and legs 360 coupled to a bottom of the seat 340. Similar to the ergonomic sitting device 20 of FIGS. 1-5, the ergonomic sitting device 320 includes shoulder assemblies 390 coupled to upper ends 400 of upper members 370. Similarly, the shoulder assemblies 390 include upwardly and forwardly angled struts 410, downwardly and forwardly angled struts 420, pad support struts 430, and comfort pads 440. Springs 450 between upwardly and forwardly angled struts 410 and downwardly and forwardly angled struts 420 urge the pads 440 rearward, towards the back 350. Springs (not shown) similar to springs 180 may be disposed in rear supports 370 to urge the shoulder assemblies 390 downward, and hence, urge the pads 440 downward. The uppers members 370 may be pivotally coupled (or fixed) to mounting assembly 460, which detachably mounts to a top 470 of the back 350 of the chair 330. The method of using the ergonomic sitting device 320 is similar to the method of using the ergonomic sitting device 20 described above with respect to FIGS. 1-5, and is incorporated herein, however, instead of the ergonomic sitting device being integrated into the chair, the ergonomic sitting device 320 is mountable to the back 350 of the chair 330.

A main advantage of the ergonomic sitting device 20, which is incorporated into a chair, is that the chair seat will tilt forward. This may not be possible in an existing chair to which add-on ergonomic sitting device 320 is placed. A main advantage of the add-on ergonomic sitting device 320 is that it can be used on multiple chairs, in the car, and on other types of sitting mechanisms like sofas, etc.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

I claim:

1. An ergonomic sitting device, comprising:

one or more rear supports configured to be secured to a rear surface of a backrest of a chair;

a pair of shoulder assemblies attached to the one or more rear supports, the pair of shoulder assemblies configured to extend forwardly over a top of the backrest of the chair and downwardly over a user's shoulders;

one or more pads carried by and extending downwardly from the shoulder assemblies and towards a chest of a user sitting in the chair;

a first set of one or more biasing mechanisms configured to urge the pair of shoulder assemblies rearward towards the backrest of the chair; and a second set of separate one or more biasing mechanisms configured to urge the pair of shoulder assemblies downward towards a sitting surface the chair, whereby the user's shoulders are actively pulled back and downwardly to improve ergonomics of the user's upper spine.

2. The ergonomic sitting device of claim 1, wherein the ergonomic sitting device is part of a chair.

3. The ergonomic sitting device of claim 2, wherein the chair and a seat are tiltable between at least an upright position and a tilted forward.

4. The ergonomic sitting device of claim 1, wherein the ergonomic sitting device is mountable to a chair.

5. An ergonomic sitting device, comprising:

one or more rear supports configured to be secured to a rear surface of a backrest of a chair;

a pair of shoulder assemblies attached to the one or more rear supports, the pair of shoulder assemblies configured to extend forwardly over a top of the backrest of the chair and downwardly over a user's shoulders;

one or more pads carried by and extending downwardly from the shoulder assemblies and in front of a user sitting in the chair;

a first set of one or more biasing mechanisms configured to urge the pair of shoulder assemblies rearward towards the backrest of the chair; and a second set of separate one or more biasing mechanisms configured to urge the pair of shoulder assemblies downward towards a sitting surface of the chair, whereby the user's shoulders are actively pulled back and downwardly to improve ergonomics of the user's upper spine, a manually adjustable shoulder assembly engagement and disengagement mechanism that enables the pads to be moved towards and away from the user.

6. A method of using the ergonomic sitting device of claim 1, comprising:

receiving an upper part of a user's torso under the pair of shoulder assemblies;

urging the upper part of the user's torso rearward towards the backrest of the chair and downward towards the sitting surface of the chair with the pair of shoulder assemblies, whereby the user's shoulders are actively pulled back and downwardly to improve ergonomics of the user's upper spine.

7. The method of claim 6, wherein the ergonomic sitting device is part of a chair.

8. The method of claim 6, wherein the ergonomic sitting device is mountable to a chair.

9. The method of claim 6, further including a manually adjustable shoulder assembly engagement and disengagement mechanism to move the pair of shoulder assemblies rearward towards a user's shoulders and forward away from the user's shoulders.

10. The method of claim 9, wherein the manually adjustable shoulder assembly engagement and disengagement mechanism moves the pads rearward towards a user's shoulders and forward away from the user's shoulders.

11. The ergonomic sitting device of claim 1, wherein the manually adjustable shoulder assembly engagement and disengagement mechanism is a ratchet mechanism.

12. An ergonomic sitting device, comprising:

one or more rear supports configured to be secured to a rear surface of a backrest of a chair;

a pair of shoulder assemblies attached to the one or more rear supports, the pair of shoulder assemblies configured to extend forwardly over a top of the backrest of the chair and downwardly over a user's shoulders;

one or more pads carried by and extending downwardly from the shoulder assemblies and towards a chest of a user sitting in the chair;

one or more biasing mechanisms configured to urge the pair of shoulder assemblies rearward towards the backrest of the chair and downward towards a sitting surface the chair, whereby the user's shoulders are actively pulled back and downwardly to improve ergonomics of the user's upper spine.

* * * * *